US006529582B2

(12) United States Patent
Feldmesser et al.

(10) Patent No.: US 6,529,582 B2
(45) Date of Patent: Mar. 4, 2003

(54) FOCUSED X-RAY SCATTER REDUCTION GRID

(75) Inventors: Howard S. Feldmesser, Columbia, MD (US); Paul R. Falk, Catonsville, MD (US); Thomas J. Beck, Baltimore, MD (US); Harry K. Charles, Jr., Laurel, MD (US)

(73) Assignee: The Johns Hopkins University, Baltimore, MD (US)

( * ) Notice: Subject to any disclaimer, the term of this patent is extended or adjusted under 35 U.S.C. 154(b) by 0 days.

(21) Appl. No.: 09/914,989

(22) PCT Filed: Feb. 1, 2001

(86) PCT No.: PCT/US01/03271

§ 371 (c)(1),
(2), (4) Date: Sep. 6, 2001

(87) PCT Pub. No.: WO01/57882

PCT Pub. Date: Aug. 9, 2001

(65) Prior Publication Data

US 2002/0176537 A1 Nov. 28, 2002

Related U.S. Application Data

(60) Provisional application No. 60/179,497, filed on Feb. 1, 2000.

(51) Int. Cl.[7] ..... G21K 1/00

(52) U.S. Cl. ..... 378/154; 378/155; 378/145; 378/147; 378/149

(58) Field of Search ..... 378/154, 155, 378/145, 147, 149

(56) References Cited

U.S. PATENT DOCUMENTS 4,951,305 A * 8/1990 Moore et al. ..... 250/363.1
5,528,659 A * 6/1996 Stein ..... 378/149
5,606,589 A * 2/1997 Pellegrino et al. ..... 378/147

* cited by examiner

*Primary Examiner*—Robert H. Kim
*Assistant Examiner*—George Wang
(74) *Attorney, Agent, or Firm*—Ernest R. Graf

(57) ABSTRACT

An X-ray scatter reduction grid includes a first layer having a plurality of cells. The cells have a perimeter formed of an X-ray absorbing material. The shape of the perimeters can vary, but a polygonal shape is preferred. The grid can also include other layers, each with their own cells. The cells of the subsequent other layers are larger than and offset from the cells of the prior layer. The increased size of the cells allows a primary ray passing through the center of a first layer cell to also pass through the center of a subsequent layer cell. This allows for a maximum of primary ray passthrough and a maximum of scatter absorption.

6 Claims, 7 Drawing Sheets

FOCUSED X-RAY SCATTER REDUCTION GRID

REFERENCE TO RELATED APPLICATION

This application claims priority of U.S. provisional application No. 60/179,497 filed Feb. 1, 2000 and hereby incorporated by reference in its entirety.

BACKGROUND OF THE INVENTION

1. Field of the Invention

This invention relates generally to a grid for use with X-rays. More particularly, this invention relates to a grid for reducing X-ray scatter. Still more particularly, this invention relates to a grid for simultaneously reducing X-ray scatter in more than one direction.

2. Description of the Related Art

X-rays are commonly used to produce images in a variety of settings, including medical diagnosis. X-rays are electromagnetic radiation of extremely short wavelengths and high energy. This is true even in the range of energies used for medical diagnosis. When an X-ray encounters an atom of matter, it may be absorbed or deflected. The deflected X-rays make up what is known as scatter. Scatter serves no useful purpose in making the final image, and distracts from the clarity of the image. Taking the field of medical diagnosis as an example, the image will ideally be made by only those X-rays that have passed directly through the patient without colliding with atoms along the path. At any given point of the image, the quantity of X-rays at that point indicates the degree of absorption of the primary beam in the patient on the line from the X-ray source to the X-ray receptor (e.g., the film). The scattered X-rays arrive at the X-ray film from various angles and places in the body not related to the path from the source to the receptor. The unwanted scattered X-rays cause the image to appear clouded. This reduces the image contrast, and obscures small variations that exist within the body being imaged.

One way to reduce X-ray scatter is through the use of a scatter reduction grid. Scatter reduction grids are made up of spaced-apart X-ray absorbing strips. FIG. 1 shows a known scatter reduction grid 100. The grid 100 is placed between an object to be imaged, such as a patient 102, and a receptor 104. Ideally, the grid 100 will allow unimpeded passage of an X-ray beam 108 that has come straight from the X-ray source 106 through the patient 102 and will absorb all of the X-ray beams 110 that were scattered by passage through the patient 102. However, as seen in FIG. 2, if the strips are made tall in relation to their spacing (a "high ratio" grid 200), they will stop most or all of the scattered rays 110, but they will also stop many of the desired primary rays 108. If the strips are short with respect to the spacing (a "low ratio" grid 300), they will allow the primary rays 108 to pass through easily, but some of the scattered X-rays 110 will also pass through.

A partial solution to this problem is the use of a focused grid 400. As seen in FIG. 3, the strips of a focused grid 400 are parallel to each other in their longitudinal direction, but lean toward each other in the direction of X-ray propagation. This allows more primary rays 108 to pass through the grid. However, the focused grid 400 performs well at only one particular distance from the X-ray source 106, since if not at its proper location, the grid 400 will trap many of the primary X-rays 108 as well as the scattered X-rays 110.

The grids described thus far are linear grids. That is, they only reduce or remove the scatter in one dimension. If the lines of the grid are oriented in a north-south direction, any scattered rays that come off in a north-south direction will not be removed. The grid will absorb only those rays scattered in an east-west direction. The typical solution is to orient two linear grids orthogonally to each other to create a cross-hatched grid. This process doubles the grid absorption, but significantly improves the image contrast by reducing the amount of scatter that reaches the detector 104. The main drawback to this approach is the removal of too many primary X-rays, requiring a higher radiation dose to the patient.

SUMMARY OF THE INVENTION

Thus, what is needed is an improved X-ray scatter reduction grid that allows for reduction of scatter in more than one direction and that removes as few primary X-rays as possible.

The present invention provides an improved scatter reduction grid having a first layer including a plurality of cells. The cells have a perimeter formed of an X-ray absorbing material. The shape of the perimeters can vary, but a polygonal shape is preferred. Preferably, the shape is a triangle, a trapezoid, a rhombus, a pentagon, a hexagon, a heptagon, or an octagon.

Subsequent layers of cells can be also included. The cells of the successive subsequent layers are larger than and offset from the prior layer cells. The increase in size of the cells in each layer depends on a number of factors, including the spacing between the layers and the distance from the radiation source. The increased size of the cells allows a primary ray passing through the center of a cell to also pass through the center of cells in subsequent layers. This allows for a maximum of primary rays to pass through the grid and allows greatly improved scatter absorption.

BRIEF DESCRIPTION OF THE DRAWINGS

The present invention is described with reference to the accompanying drawings, in which like reference characters reference like elements, and wherein.

DETAILED DESCRIPTION OF THE PREFERRED EMBODIMENT

Figure 1:
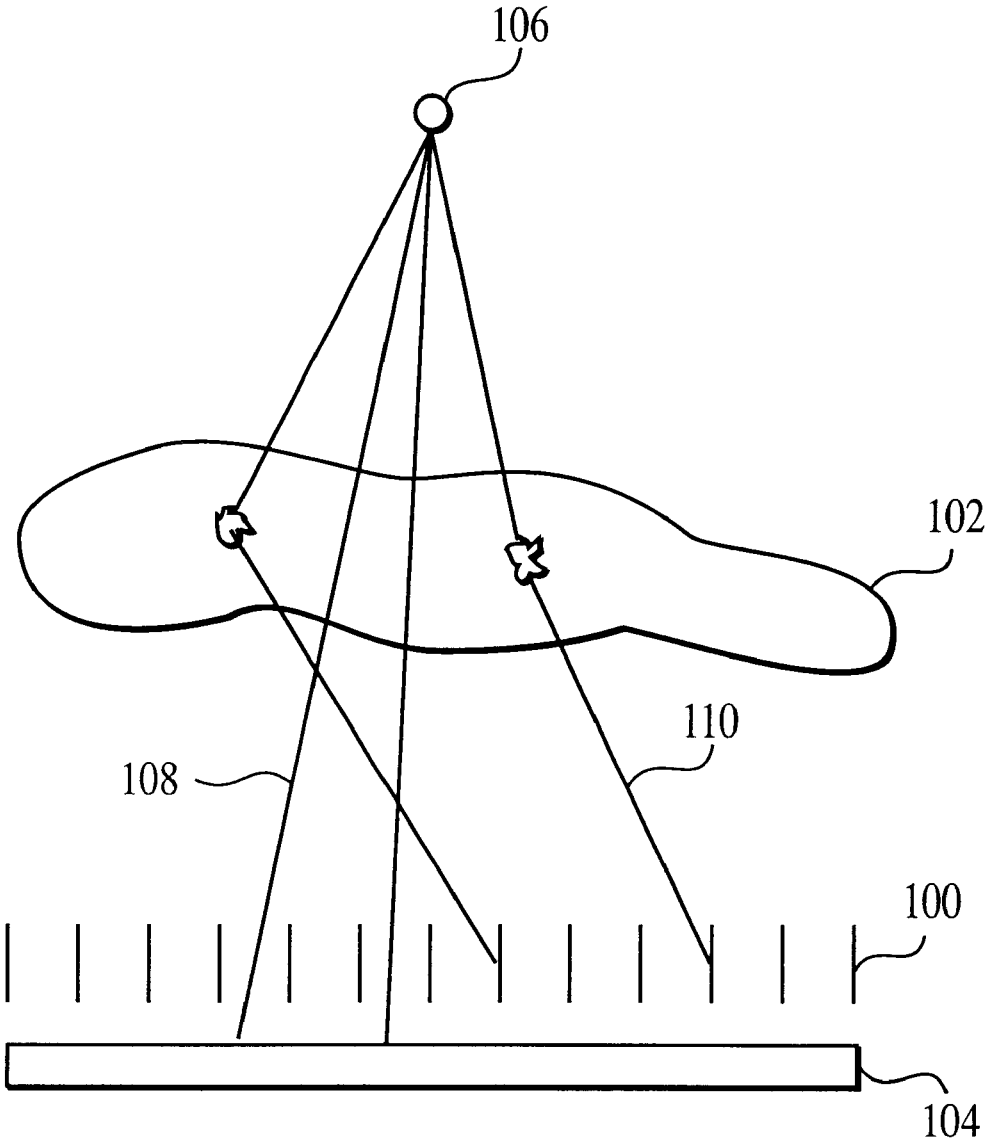
FIG. 1 is a side view of a known X-ray absorbing grid.
Figure 2:
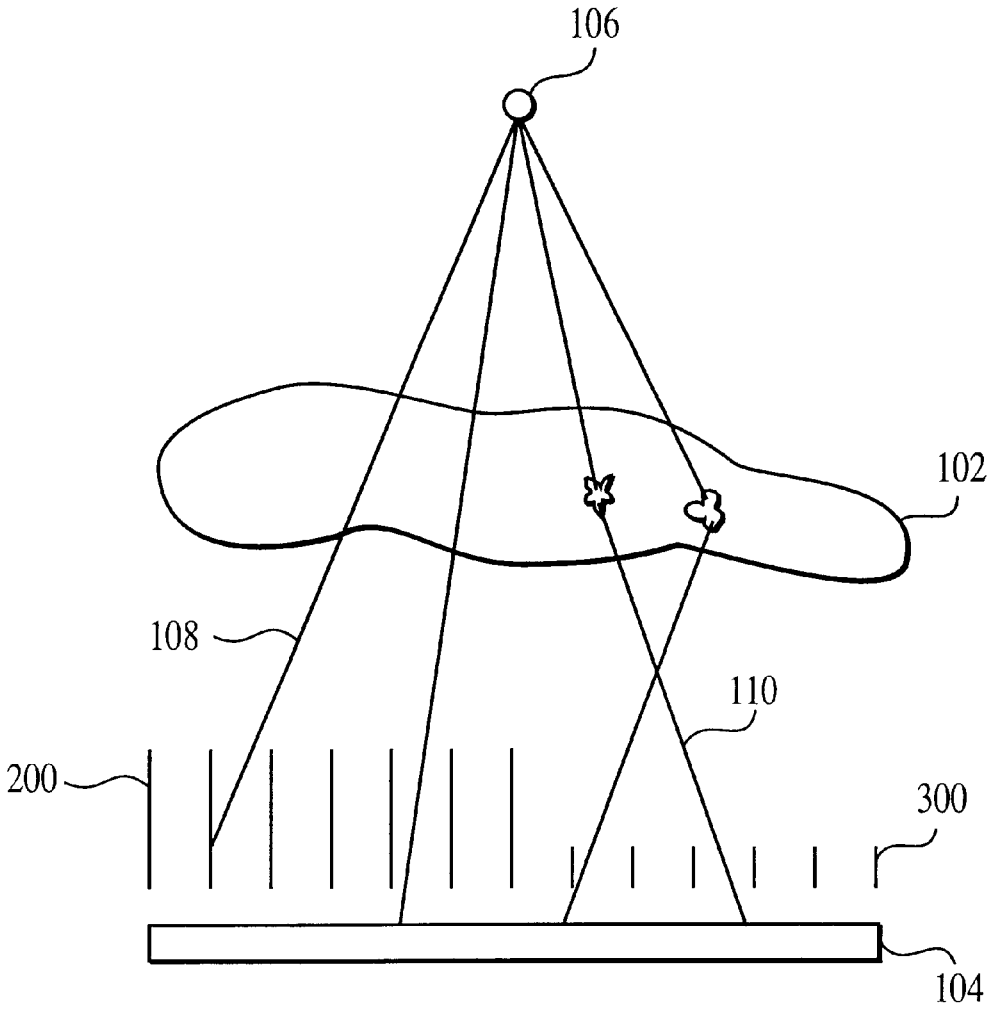
FIG. 2 PRIOR ART
FIG. 2 is a side view of a known X-ray absorbing grid.
Figure 3:
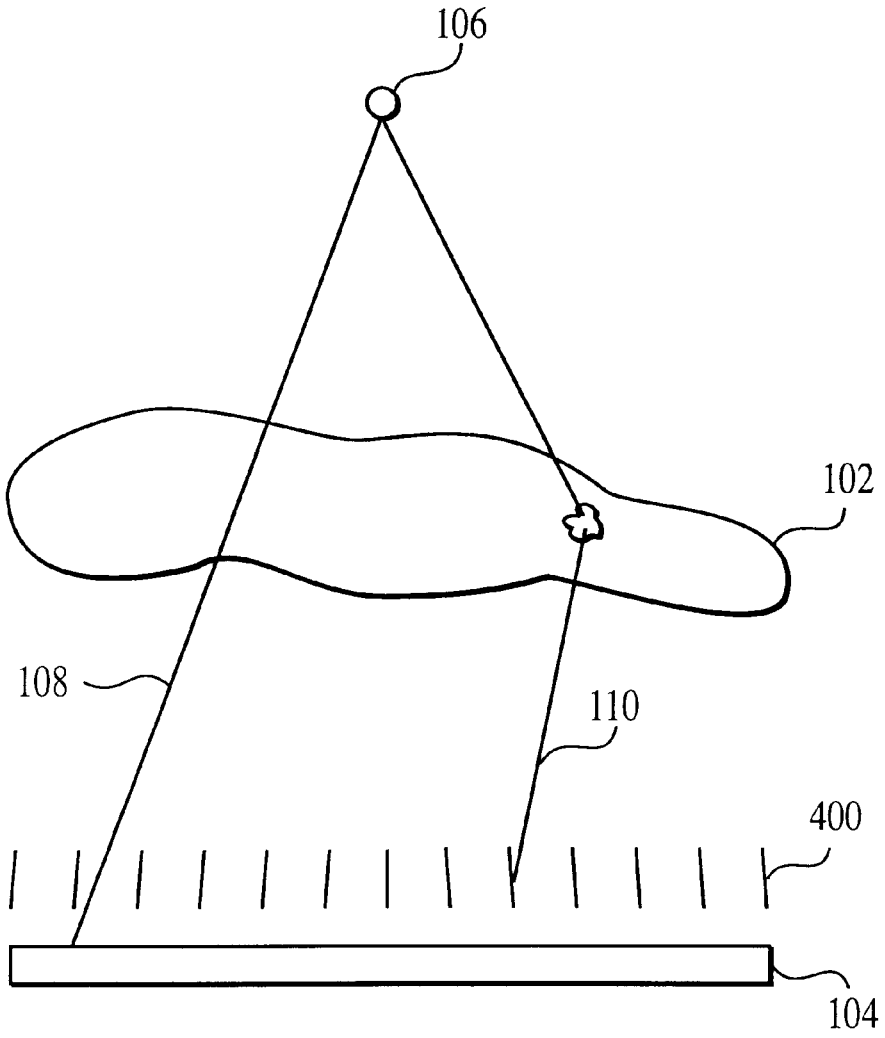
FIG. 3 PRIOR ART
FIG. 3 is a side view of a known X-ray absorbing grid.
Figure 4:
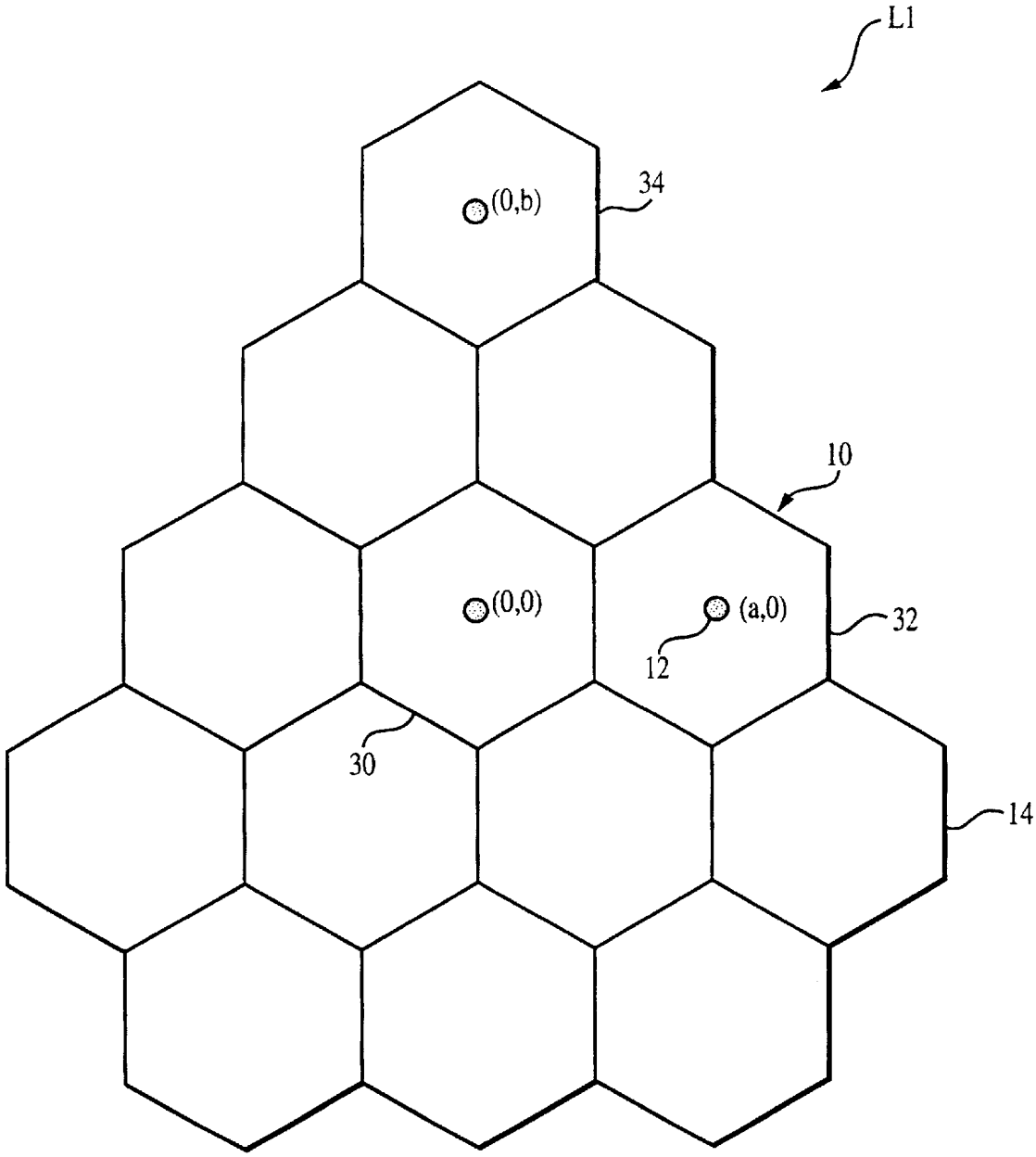
FIG. 4 is a top view of a first layer of an X-ray absorbing grid in accordance with an embodiment of the present invention.

FIG. 4 is a top view of a first layer of an X-ray absorbing grid in accordance with the present invention. In FIG. 4 a first grid layer L1 includes a plurality of cells 10. Each cell 10 has a center 12 and a perimeter 14. Perimeter 14 is formed of a material that absorbs X-rays. Thus, X-rays impacting perimeter 14 will be absorbed and will not be reflected onto the X-ray receptor. This allows a clearer X-ray image to be created. The number of cells 10 included in a layer varies according to the particular application.

A hexagonal perimeter 14 is shown in the figures. However, any shape, preferably a polygon, is possible for perimeter 14. A shape with a plurality of straight sides is preferred in order to facilitate assembly of a plurality of cells 10. Regardless of the number of sides perimeter 14 has, the shape provides for multidimensional scatter reduction. That is, a single layer L1 will absorb scatter in two, orthogonal dimensions.

In practice, X-rays are typically emitted from a point source. Like other forms of electromagnetic radiation, X-rays emitted from a point source are propagated in a plurality of directions. That is, the emitted X-rays contain a plurality of nonparallel vectors originating from the source. For purposes of illustration, only a single plane of emitted X-rays will be discussed.

Figure 6:
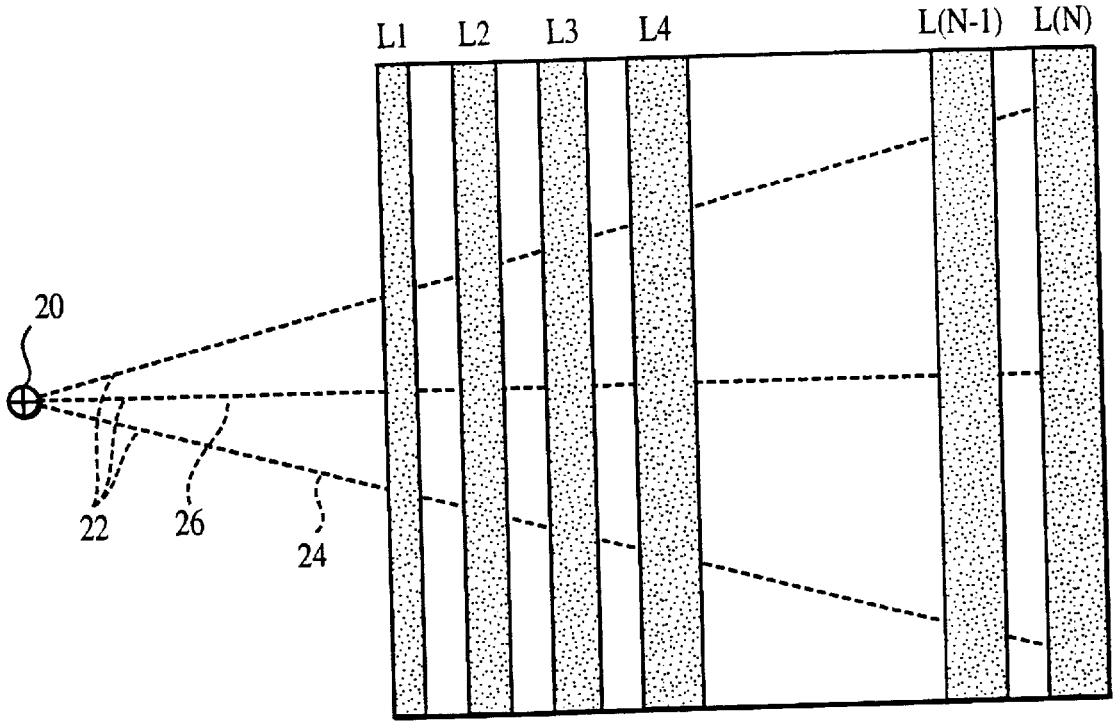
FIG. 6 is a side view of a grid comprising the layers of FIGS. 4 and 5.

FIG. 6 shows a side view of a grid comprising a plurality of layers L1, L2, L3, L4, L(N−1), and L(N). A radiation source 20 emits X-rays 22 in a multitude of nonparallel directions, including angled X-rays 24 that are angled relative the X-ray receptor and central X-rays 26 that are substantially perpendicular to the X-ray receptor. Perimeters 14 are large enough to allow a large majority of the angled primary rays 24 to pass through without contacting perimeter 14 (and therefore without being absorbed). Similarly, the height of perimeter 14 is such that primary rays are not absorbed. As the angled X-rays 24 propagate from source 20, they spread away from central X-ray 26 in the direction of propagation.

To increase the effectiveness of the grid, a plurality of layers can be used. This allows an increased surface area of X-ray absorbing material to combat scattered X-rays. Due to the spread of the angled primary X-rays 24, however, the cells of the respective layers must be shifted. Otherwise the result would be to effectively create a single cell of relatively great height, which would result in the absorption of primary X-rays.

By using multiple layers, scatter reduction can be improved. For each successive layer, the cell size is varied. This allows rays passing through a first layer cell to also pass through a second layer cell. It will also be understood that because of the spread of X-rays 24, the height of the cells of lower layers can be greater than the height of the cells of the first layer while still allowing all primary rays 22 to pass through the grid.

A magnification factor (M) for each layer of the grid can be calculated according to the following formula:

$$M=F+(x-1)*h/F,$$

where F is the distance from the radiation source to the first layer, x is the layer in question, and h is the height of a single layer. By increasing the size of the cells by the multiplication factor associated with the particular layer, a grid allowing for both maximum passage of primary rays and maximum absorption of scatter rays can be fabricated. Thus, the radius of a circle circumscribed about a cell of the second layer (d2) equals the radius of a circle circumscribed about a cell of the first layer (d1) times the magnification factor. That is, d2=d1*M, or $$d2=d1*F+h/F.$$

Figure 5:
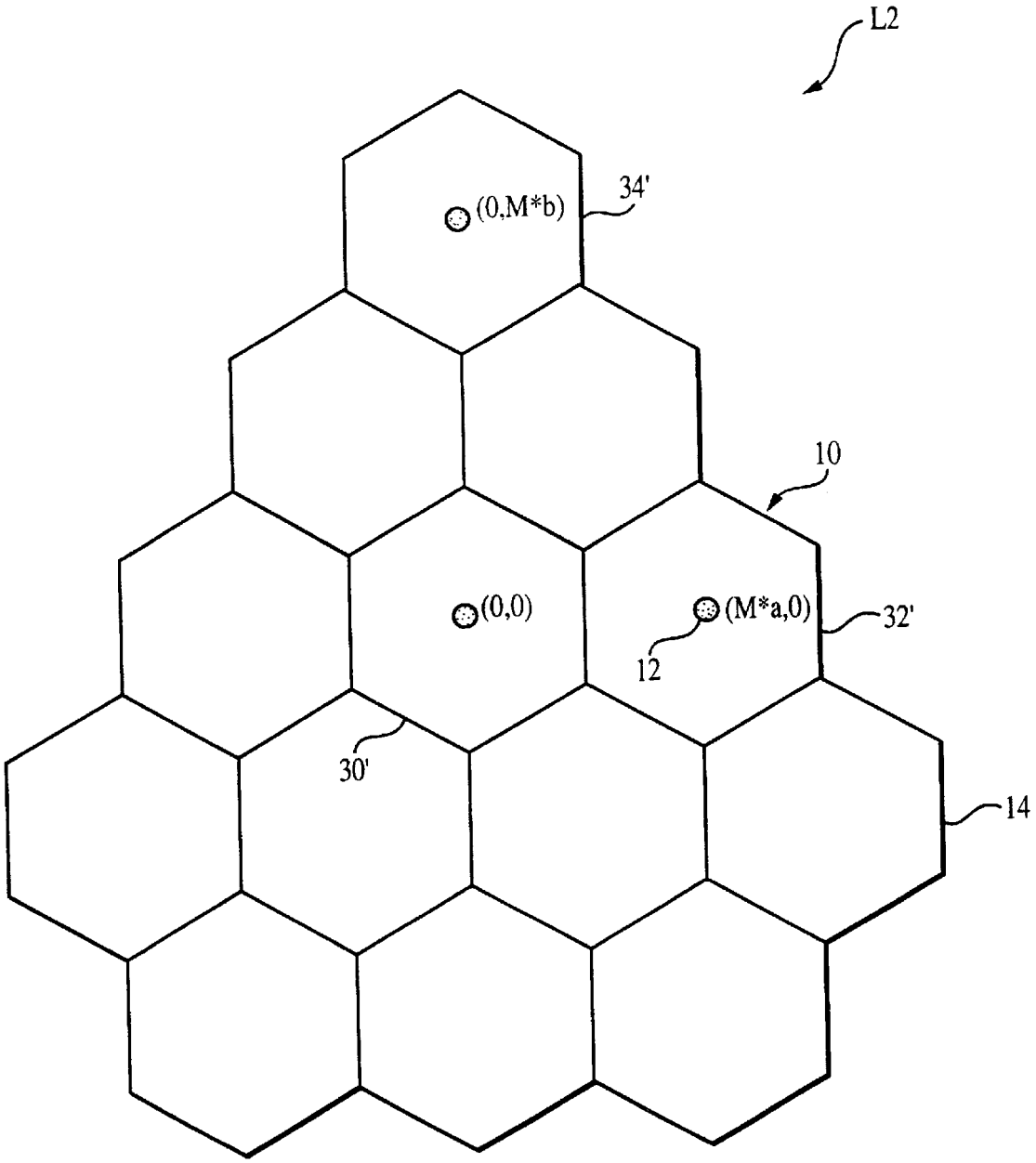
FIG. 5 is a top view of a second layer of an X-ray absorbing grid in accordance with an embodiment of the present invention.

This increase in cell size is illustrated in FIGS. 4 and 5. With respect to FIG. 4, first layer L1 is shown. Layer L1 includes individual cells 30, 32, and 34. Cell 32 is located a distance "a" away from cell 30, and cell 34 is located a distance "b" away from cell 30. Taking the center of cell 30 as the origin (0,0), it is seen that the center of cell 32 is located at (a,0) and the center of cell 34 is located at (0,b).

With respect to FIG. 5, a second layer L2 is shown. Layer L2 includes individual cells 30', 32', and 34', which correspond to cells 30, 32, and 34, respectively. Due to magnification, the cells of layer L2 are increased by the magnification factor M.

Thus, taking the center of cell 30' as the origin (0,0), the center of cell 32' is located at (M*a,0) and the center of cell 34' is located at (0,M*b).

Figure 7:
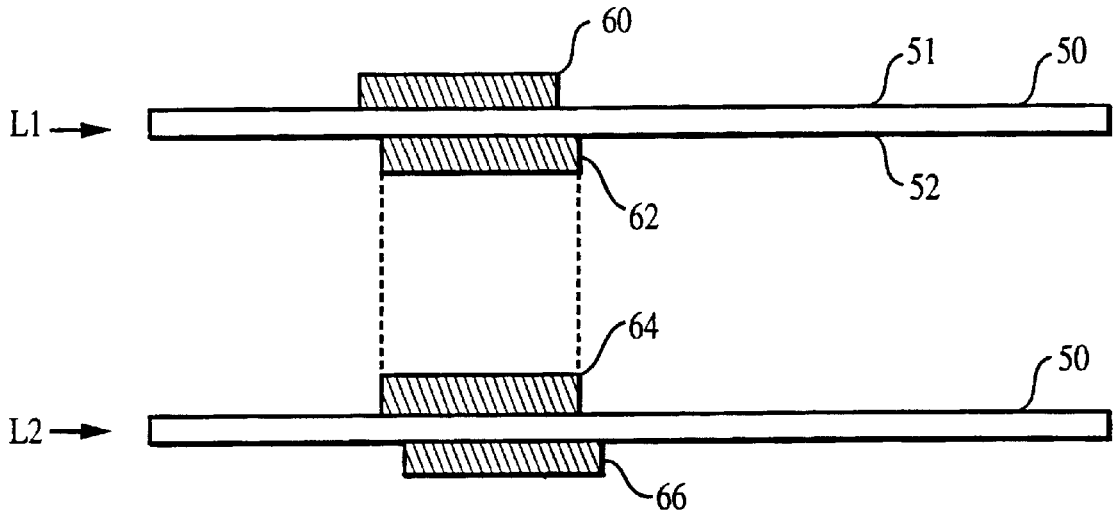
FIG. 7 is a partial side view of two layers in accordance with the present invention.

FIG. 7 is a partial side view of two layers in accordance with the present invention. Each layer of the grid has a substrate 50 and a plurality of cells 10. For convenience, only a partial view of each layer is shown. Substrate 50 has a first surface 51 and a second surface 52. Layer L1 has a cell 60 located on the first surface 51 and a cell 62 located on the second surface 52. Cell 60 is offset from cell 62. The advantages of offsetting the cells are discussed above. Layer L2 has a cell 64 on the first surface of the substrate and a cell 66 on the second surface of the substrate, cells 64 and 66 being offset. As shown by dashed lines in FIG. 7, cell 64 on the first surface of the second layer L2 is substantially aligned with cell 62 on the second surface of the first layer L1.

Substrate 50 can be formed of any material that is substantially transparent to X-rays. Possible materials for substrate 50 include glass, aluminum, fiberglass reinforced plastic (epoxy or polyamide), and carbon reinforced plastic. Basically, any low atomic number material can be used. As stated previously, cells 10 are formed of a material that absorbs X-rays. Possible materials for cells 10 include heavy metals such as lead, nickel, cobalt, iron, tungsten, tantalum, and alloys thereof. Basically, any high atomic number material can be used. A layer can be included between the cells 10 and substrate 50 to facilitate adhesion of the cells 10 to the substrate 50. One possible adhesion facilitating material is copper.

Figure 8:
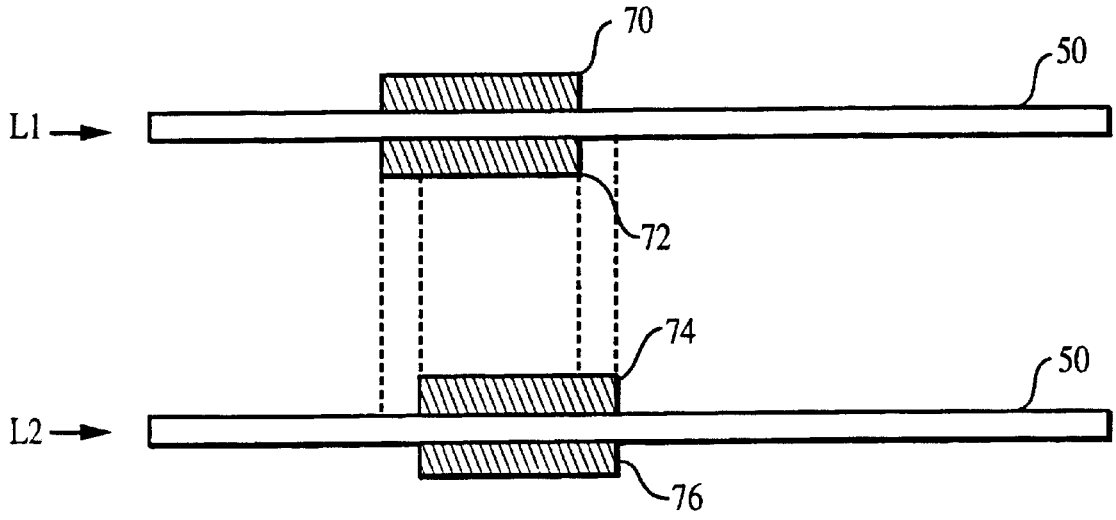
FIG. 8 is a partial side view of two layers in accordance with the present invention.

FIG. 8 is a partial side view of two layers in accordance with the present invention. For convenience, only a partial view of each layer is shown. Similar to the embodiment of FIG. 7, each layer has a substrate 50 and a plurality of cells 10. Each substrate 50 has first and second surfaces with a cell located on each surface. Unlike the embodiment of FIG. 7, cells on respective surfaces of a layer are substantially aligned rather than being offset. That is, cell 70 and cell 72 are substantially aligned, and cell 74 and cell 76 are substantially aligned. However, as shown by dashed lines, the cells of subsequent layers are offset. That is, cells 70 and 72 are offset from cells 74 and 76.

Adjacent layers may be coupled in any convenient manner. For example, the first layer L1 may merely be positioned above the second layer L2. A layer of supporting material may optionally be placed intermediate adjacent layers.

Although only a single plane of emitted X-rays was illustrated in the above discussion, it will readily be appreciated that the same analysis applies to the entire gamut of emitted X-rays.

The cells can be of any shape that permits close packing arrays. Preferred shapes include a triangle, a trapezoid, a rhombus, a pentagon, a hexagon, a heptagon, or an octagon.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. An X-ray scatter reduction grid, comprising:

a first layer including a first plurality of cells, each of said first plurality of cells having a center and a perimeter, said perimeter comprising an X-ray absorbing material, wherein a circle circumscribed about one of said first plurality of cells has a radius equal to a first distance;

a second layer including a second plurality of cells, each of said second plurality of cells having a center and a perimeter formed of an X-ray absorbing material, wherein a circle circumscribed about one of said second plurality of cells has a radius equal to a second distance, said second distance being greater than said first distance;

wherein said second layer is positioned with respect to said first layer such that an X-ray passing through the center of a first layer cell will also pass through the center of a second layer cell;

wherein said perimeters have a shape selected from the group consisting of a triangle, a trapezoid, a rhombus, a pentagon, a hexagon, a heptagon, and an octagon; and wherein said second distance is about a multiple of said first distance according to the following formula $$d2=d1*F+h/F,$$

where d1 is said first distance, d2 is said second distance, F is a distance from the radiation source to said first layer, and h is a height of said first layer.

2. The X-ray scatter reduction grid of claim 1, wherein:

said second layer is operatively coupled to said first layer.

3. The X-ray scatter reduction grid of claim 1, further comprising:

a layer of supporting material intermediate said first layer and said second layer.

4. An X-ray scatter reduction grid, comprising:

a first layer including a first plurality of cells, each of said first plurality of cells having a center and a perimeter, said perimeter comprising an X-ray absorbing material, wherein a circle circumscribed about one of said first plurality of cells has a radius equal to a first distance;

a second layer including a second plurality of cells, each of said second plurality of cells having a center and a perimeter formed of an X-ray absorbing material, wherein a circle circumscribed about one of said second plurality of cells has a radius equal to a second distance, said second distance being greater than said first distance;

wherein said second layer is positioned with respect to said first layer such that an X-ray passing through the center of a first layer cell will also pass through the center of a second layer cell;

wherein said perimeters have a shape selected from the group consisting of a triangle, a trapezoid, a rhombus, a pentagon, a hexagon, a heptagon, and an octagon;

wherein said first layer has a first height; and said second layer has a second height, said second height being greater than said first height.

5. The X-ray scatter reduction grid of claim 4, wherein:

said second layer is operatively coupled to said first layer.

6. The X-ray scatter reduction grid of claim 4, further comprising:

a layer of supporting material intermediate said first layer and said second layer.

* * * * *